US007581621B2

(12) United States Patent
Kontturi

(10) Patent No.: US 7,581,621 B2
(45) Date of Patent: Sep. 1, 2009

(54) METHOD AND APPARATUS FOR CONTROLLING ADVANCE OPENING OF DOORS IN AN ELEVATOR

(75) Inventor: Risto Kontturi, Rajamäki (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 12/155,845

(22) Filed: Jun. 10, 2008

(65) Prior Publication Data

US 2008/0289907 A1 Nov. 27, 2008

Related U.S. Application Data

(63) Continuation of application No. PCT/FI2006/000367, filed on Nov. 13, 2006.

(30) Foreign Application Priority Data

Dec. 29, 2005 (FI) ..... 20051335

(51) Int. Cl.
*B66B 13/14* (2006.01)

(52) U.S. Cl. ..... 187/316; 187/291; 187/393; 187/902

(58) Field of Classification Search ..... 187/277, 187/291, 393, 394, 284, 380–388, 391, 293, 187/902, 316, 317, 249
See application file for complete search history.

(56) References Cited

U.S. PATENT DOCUMENTS

| | | | | |
|---|---|---|---|---|
| 5,907,136 | A | 5/1999 | Hongo et al. | |
| 6,334,511 | B1 * | 1/2002 | Araki | 187/380 |
| 7,090,056 | B2 * | 8/2006 | Fujita et al. | 187/380 |

FOREIGN PATENT DOCUMENTS

| | | | |
|---|---|---|---|
| DE | 1113293 | | 8/1961 |
| EP | 1 074 503 | A2 | 2/2001 |
| JP | 2000-296971 | A | 10/2000 |
| JP | 2001-233553 | A | 8/2001 |
| JP | 2004-10174 | A | 1/2004 |
| JP | 2004-238189 | A | 8/2004 |

* cited by examiner

*Primary Examiner*—Jonathan Salata
(74) *Attorney, Agent, or Firm*—Birch, Stewart, Kolasch & Birch, LLP

(57) ABSTRACT

A method and an apparatus controls advance opening of doors in a double-deck elevator, in which elevator a car frame supporting the elevator cars is moved by means of a set of hoisting ropes by a hoisting machine provided with a traction sheave. When the elevator is approaching the target floor levels, the velocity of the elevator cars in the car frame in relation to the car frame is measured and, based on the measurement result, the velocity of the elevator cars relative to the floor levels is calculated.

6 Claims, 3 Drawing Sheets

METHOD AND APPARATUS FOR CONTROLLING ADVANCE OPENING OF DOORS IN AN ELEVATOR

Figure 1:
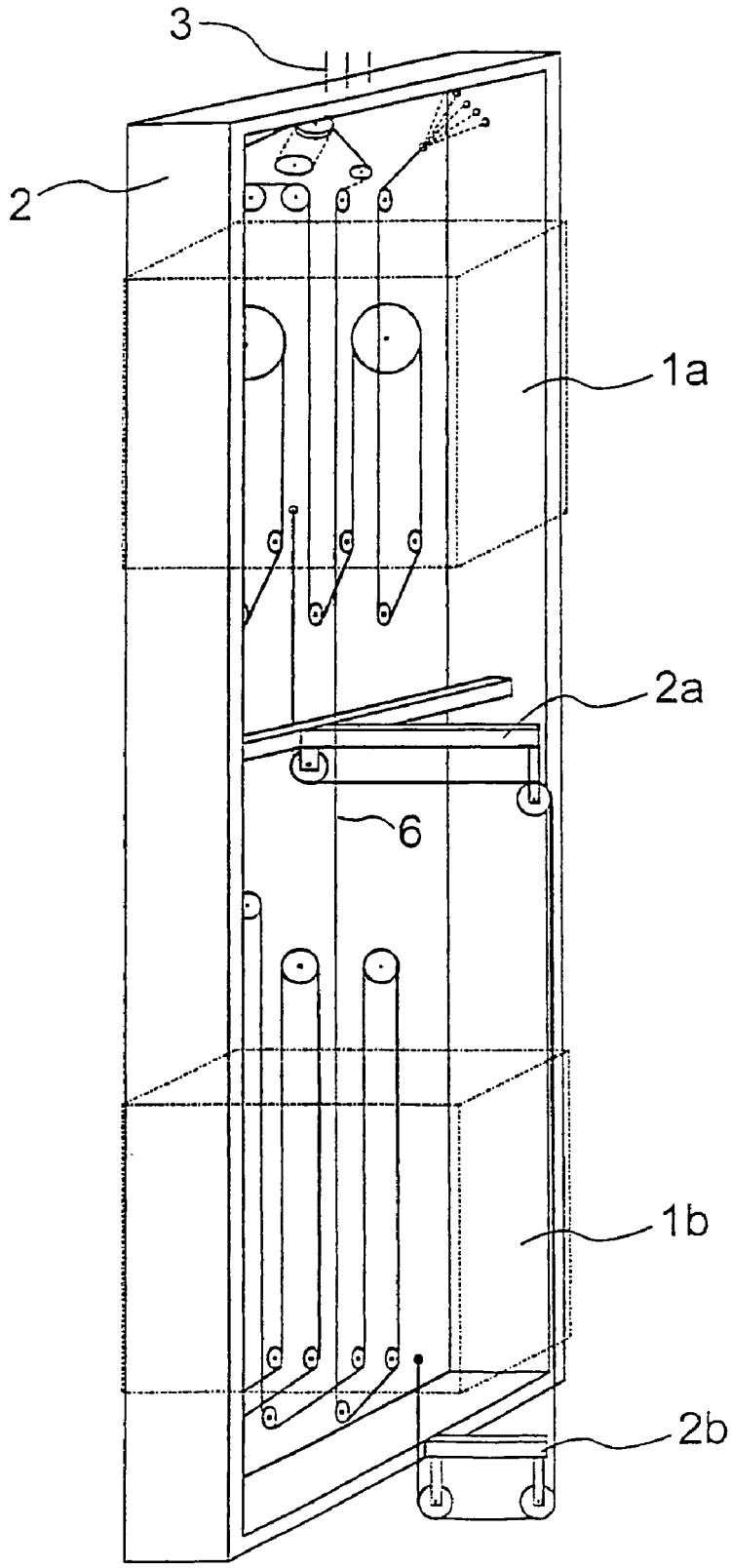

This application is a Continuation of copending PCT International Application No. PCT/FI2006/000367 filed on Nov. 13, 2006, which designated the United States, and on which priority is claimed under 35 U.S.C. § 120. This application also claims priority under 35 U.S.C. § 119(a) on Patent Application No(s). 20051335 filed in Finland on Dec. 29, 2005. The entire contents of each of the above documents is hereby incorporated by reference.

BACKGROUND OF THE INVENTION

1. Field of the Present Invention

The present invention relates to a method and to an apparatus for controlling advance opening of doors in a twin car elevator.

In particular, the invention relates to the control of advance opening of the doors of the elevator cars of a twin-car elevator, i.e. a so-called double-deck elevator, which are placed one above the other, and the corresponding landing doors.

2. Description of the Related Art

Elevators having two elevator cars placed one above the other in the same car frame are used e.g. in high-rise buildings to increase the transport capacity. Such double-deck elevators may function e.g. as collecting elevators serving only certain floors.

Traditionally, double-deck elevators have had a fixed inter-car distance, as described e.g. in the old German patent specification DE1113293. Controlling the advance opening of doors in double-deck elevators with a fixed inter-car distance is in principle not substantially more difficult than in normal single-car elevators, but double-deck elevators with a fixed inter-car distance, however, involve the problem that in many houses the distances between floors are not mutually equal. Often, especially in modern tall buildings, the entrance hall has a larger height dimension than the other floors. Likewise, the building may contain other special floors of different heights. Moreover, in tall buildings the tolerances may multiply and thus the floor heights of the upper and lower floors may be unequal. In such buildings, only one of the cars in double-deck solutions with a fixed inter-car distance can be driven accurately into position while the other car remains above or below the floor level by an amount corresponding to the difference. This shortcoming is a restriction to the application of double-deck solutions with a fixed inter-car distance.

To solve the above-mentioned problem, double-deck elevators have been developed in which the vertical distance between elevator cars placed in the same car frame, i.e. the inter-floor distance, can be adjusted within suitable limits.

For example, U.S. Pat. No. 5,907,136 discloses a solution where the elevator cars in a car frame are raised or lowered relative to each other and the car frame by means of a lifter and a scissors mechanism provided in the car frame. The car frame is additionally provided with an intermediate beam with a fixing point for the hinge of the scissors mechanism. The upper car is lifted by rotating lifting screws by means of a lifting device, such as a motor provided in the car frame, or by using power cylinders. When the upper car is moving in one direction, the lower car, forced by the scissors mechanism, is simultaneously moving in the other direction.

Similarly, EP specification EP1074503 describes two elevator cars placed one above the other in a car frame which are coupled to be movable by thick threaded bars in relation to each other and the car frame. The threads on the threaded bar moving the upper car are pitched in the opposite sense relative to the threads on the threaded bar moving the lower car, so when threaded bars are rotated, the elevator cars move in opposite directions. The motor driving the threaded bars is disposed in the upper part of the car frame.

In addition, Japanese patent specifications JP2001233553, JP2004010174 and JP2004238189 present double-deck solutions in which the distance between the two elevator cars in the car frame can be adjusted to bring the elevator cars level with different floors.

Although the prior-art solutions referred to above do redress the drawback caused by the first-mentioned fixed inter-car distance in double-deck elevators, none of these specifications proposes a solution for controlling the advance opening of the doors of double-deck elevators so as to allow the door opening action to be safely started as early as possible. The problem is typically that the mutual motion and speed of the elevator cars in the car frame relative to the landings are not necessarily the same, because the elevator cars may be moving in different directions relative to the car frame when the elevator is arriving at landings.

SUMMARY OF THE INVENTION

The object of the present invention is to overcome the above-mentioned drawbacks and to achieve a reliable and economical method and apparatus for controlling advance opening of doors in double-deck elevators.

The method of the invention is characterized by what is presented in the characterization part of claim 1, and the apparatus of the invention is characterized by what is presented in the characterization part of claim 5. Other embodiments of the invention are characterized by what is disclosed in the other claims.

Inventive embodiments are also presented in the description part and drawings of the present application. The inventive content disclosed in the application can also be defined in other ways than is done in the claims below. The inventive content may also consist of several separate inventions, especially if the invention is considered in the light of explicit or implicit sub-tasks or with respect to advantages or sets of advantages achieved. In this case, some of the attributes contained in the claims below may be superfluous from the point of view of separate inventive concepts. Correspondingly, details described in connection with each embodiment example of the invention can be used in other embodiment examples as well.

The solution of the invention provides the advantage that, irrespective of the mechanism of adjustment of the inter-car distance, the velocity and motion of each elevator car can be measured in relation to the landings, and the door opening operation can be started safely in advance regardless of different velocities and different directions of motion of the elevator cars. This makes it possible to achieve a very good transport capacity, among other things.

In an embodiment of the method, the velocity of the upper elevator car relative to the higher landing is calculated by subtracting the velocity of the upper elevator car relative to the car frame from the velocity of the car frame, and that the velocity of the lower elevator car relative to the lower landing is calculated by subtracting the velocity of the lower elevator car relative to the car frame from the velocity of the car frame.

In an embodiment of the method, the velocities of the elevator cars are measured using velocity measuring means provided in conjunction with the car frame, and that the measurement results are passed to calculating means, said calculating means being used to calculate the velocities of the elevator cars relative to the target landings.

In an embodiment of the method, the data calculated by the calculating means regarding the velocities of the elevator cars relative to the target landings is passed further to the elevator control system for advance opening of the doors.

In an embodiment of the apparatus, the apparatus comprises calculating means adapted to calculate the velocities of the elevator cars relative to the target landings on the basis of measured velocity data for the car frame and elevator cars.

In an embodiment of the apparatus, the calculating means are connected to the elevator control system to deliver the calculated velocity data to the control system, and the control system is adapted to issue on the basis of the calculated velocity data a command for advance opening of the doors.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 2:
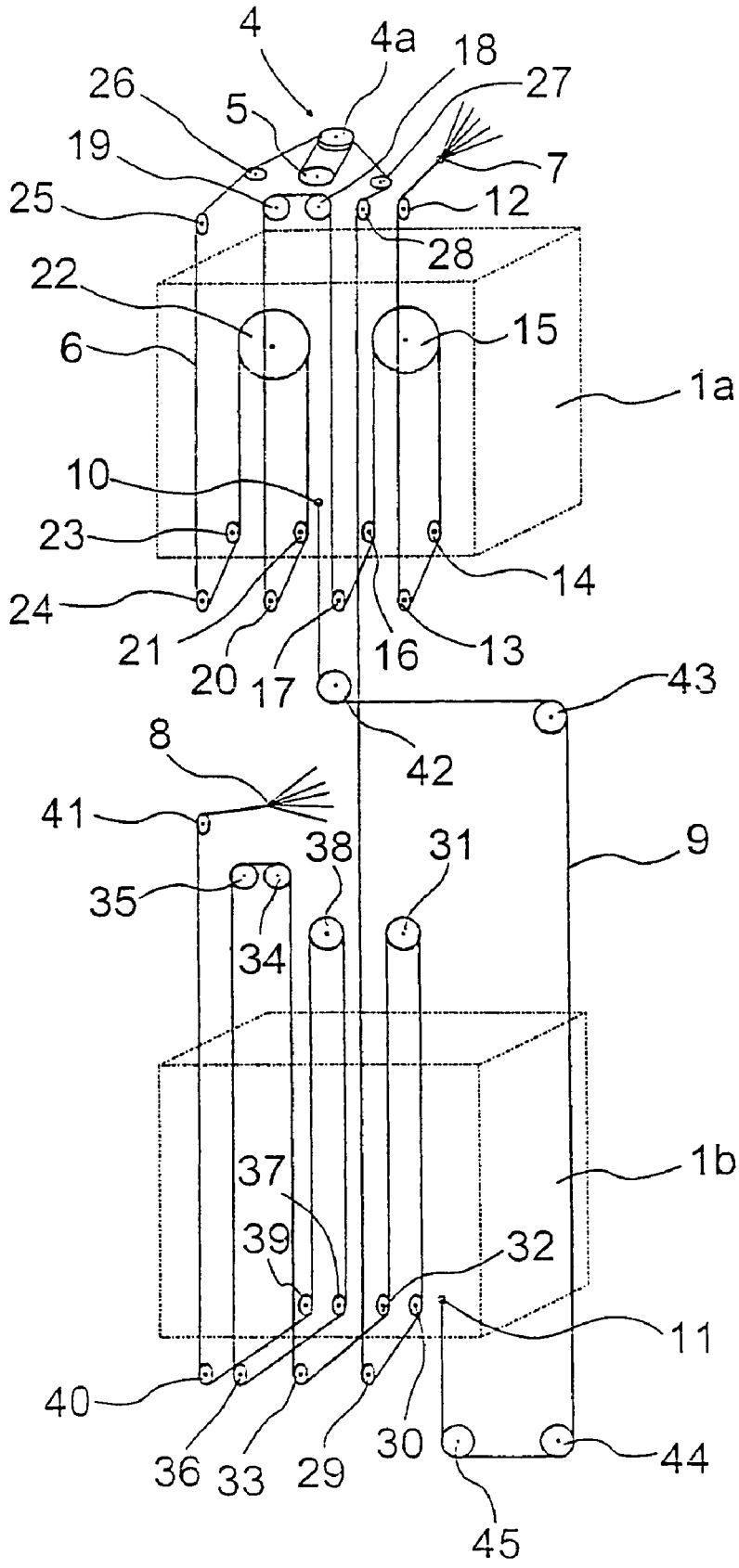
Figure 3:
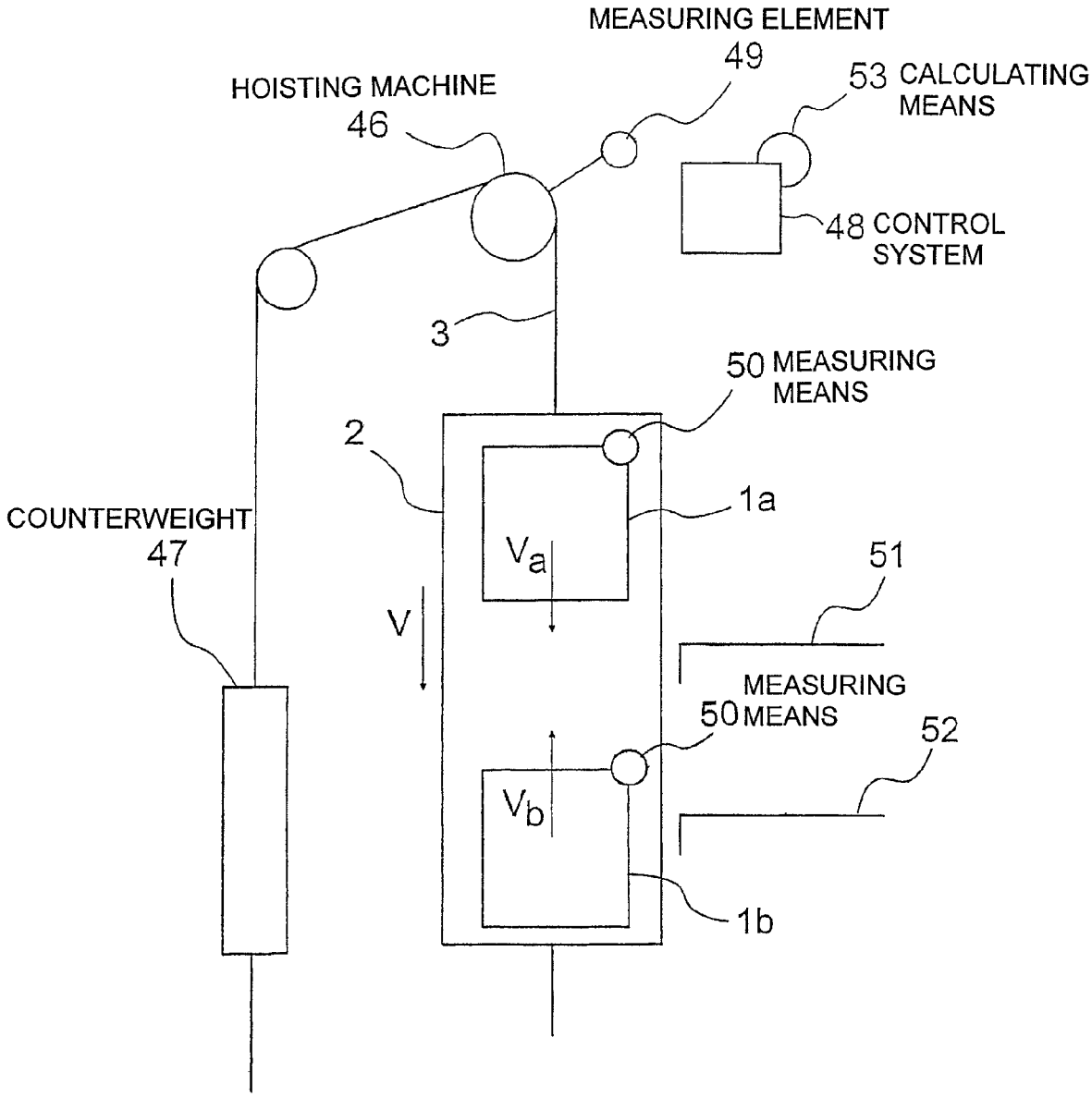

In the following, the invention will be described in detail by referring to two different embodiment examples and the attached drawings, wherein FIG. 1 presents a simplified oblique top view of a double-deck elevator solution applying the invention FIG. 2 presents a simplified oblique top view of the elevator solution of FIG. 1 without the car frame, and FIG. 3 is a simplified diagrammatic representation of the solution of the invention for controlling the velocity of the elevator cars.

DETAILED DESCRIPTION OF THE PREFERRED EMBODIMENTS

The elevator cars can be moved in the car frame in many different ways. FIG. 1 presents a typical double-deck elevator solution applying the invention, comprising elevator cars 1*a* and 1*b* suspended and supported inside a common car frame 2 by a set of adjusting ropes 6. The car frame 2 is suspended and supported by a set of hoisting ropes 3 and it moves upwards and downwards in a substantially vertical direction along guide rails in an elevator shaft. The hoisting power to the elevator is supplied by hoisting machine controlled by a control system. The control system 48 and hoisting machine 46 with a traction sheave are presented in a diagrammatic and simplified form in FIG. 3.

FIG. 2 presents the elevator of FIG. 1 without the car frame for the sake of clarity. The upper elevator car 1*a* and the lower elevator car 1*b* are suspended and supported by the set of adjusting ropes 6 in such a way that they function as counterweights for each other. The set of adjusting ropes 6 is moved by an adjusting mechanism 4 controlled by the elevator control system. The adjusting mechanism 4, which placed in the car frame, comprises at least a drive pulley 4*a* fitted to be rotatable about a substantially vertical axis and diverting pulley 5 fitted to be rotatable about a substantially vertical axis. The adjusting mechanism 4 is disposed above the upper elevator car 1*a* in a substantially horizontal plane, so it does not take up much space in the vertical direction.

The first end of the set of adjusting ropes 6 is secured to an anchorage point 7 on the car frame 2 above the upper elevator car 1*a*. From the anchorage point 7, the set of adjusting ropes 6 is passed over a diverting pulley 12 on the car frame 2 and then further under a diverting pulley 13 placed below the elevator car 1*a* and rotatably mounted on the car 1*a*, and further under the elevator car 1*a* to a diverting pulley 14 likewise rotatably mounted on the elevator car. Having passed under and around this pulley, the adjusting ropes are passed further over a diverting pulley 15 rotatably mounted on the car frame, and then further over a diverting pulley 16 rotatably mounted on the elevator car and again under the car 1*a* to a diverting pulley 17 rotatably mounted on the elevator car. Having passed under this pulley, the ropes 6 run further over diverting pulleys 18 and 19 placed above the elevator car 1*a* and rotatably mounted on the car frame, and having passed over those pulleys the adjusting ropes run further under a diverting pulley 20 rotatably mounted on the car 1*a* below the elevator car 1*a* and again under the car 1*a* further under and around a diverting pulley 21 rotatably mounted on the elevator car, from where the ropes are passed upwards over a diverting pulley 22 mounted on the car frame and further under a diverting pulley 23 rotatably mounted on the elevator car and again under the car 1*a* and under and around a diverting pulley 24 rotatably mounted on the elevator car 1*a*, from where they run over a diverting pulley 25 rotatably mounted on the car frame above the car 1*a* to a diverting pulley 26 on the car frame. Having passed around this pulley, the adjusting ropes 6 are passed to the drive pulley 4*a*. All the above-mentioned diverting pulleys on the elevator car are rotatably mounted with bearings on the upper elevator car 1*a*.

Having looped around the drive pulley 4*a*, the set of adjusting ropes 6 are passed around a diverting pulley 5 and then back to the drive pulley 4*a*. This arrangement increases the friction between the drive pulley 4*a* and the adjusting ropes 6, and therefore the adjusting ropes 6 can not slip on the drive pulley 4*a*. Next, the set of adjusting ropes 6 is passed from the drive pulley 4*a* around diverting pulleys 27 and 28 mounted on the car frame and further under a diverting pulley 29 rotatably mounted on the lower elevator car 1*b* below the elevator car 1*b*, from where the ropes are passed further under the car 1*b* and further under and around a diverting pulley 30 rotatably mounted on the elevator car 1*b* and from there further around a diverting pulley 31 rotatably mounted on the car frame above the car 1*b*. From here, the adjusting ropes are passed again under a diverting pulley 32 rotatably mounted on the elevator car 1*b* below the car 1*b* and again under the car 1*b* and under and around a diverting pulley 33 rotatably mounted on the elevator car 1*b*, from where they run again over diverting pulleys 34 and 35 rotatably mounted on the car frame above the car 1*b* and then again under a diverting pulley 36 rotatably mounted on the elevator car 1*b* below the car 1*b*, and further under the car 1*b* and under a diverting pulley 37 rotatably mounted on the elevator car 1*b* and again over a diverting pulley 38 rotatably mounted on the car frame above the car 1*b*. From here, the ropes are passed under a diverting pulley 39 rotatably mounted on the elevator car 1*b* below the car 1*b* and further under the car 1*b* and under a diverting pulley 40 rotatably mounted on the elevator car 1*b*, and from there to a diverting pulley 41 rotatably mounted on the car frame above the car 1*b*. Having passed over this pulley, the set of adjusting ropes 6 is passed to an anchorage point 8 in the car frame 2, to which the second end of the set of adjusting ropes 6 is secured.

When the adjusting mechanism 4 is rotating the drive pulley 4*a*, the distance between the elevator cars 1*a* and 1*b* supported by the set of adjusting ropes 6 either increases or decreases, depending on the direction of rotation. In this way, the inter-floor distance can be appropriately adjusted as required.

Fastened between the elevator cars 1*a* and 1*b* is also a connecting rope 9 of fixed length. The first end of the connecting rope 9 is secured to fixing point 10 in the lower part of the upper elevator car 1*a*, from where the connecting rope 9 is passed under an inner diverting pulley 42 rotatably mounted on an intermediate beam structure 2*a* of the car frame and then further over an outer diverting pulley 43 rotatably mounted on the intermediate beam structure of the car frame 2*a*, from where the connecting rope 9 is passed under diverting pulleys 44 and 45 rotatably mounted below the lower elevator car 1*b* on a supporting structure 2*b* of the car frame, and then further to an anchorage point 11 in the lower part of the lower elevator car 1*b*, to which the second end of the connecting rope 9 is secured. The function of the connecting rope 9 is to prevent a possible jump-up of the elevator cars 1*a* and 1*b* e.g. in the event of the elevator counterweight hitting the buffer.

Adjustment of the vertical distance between the elevator cars is thus accomplished by moving the elevator cars 1*a* and 1*b* in the vertical direction either closer to each other or farther away from each other by means of the adjusting mechanism 4 and adjusting ropes 6.

Advance opening of the doors is typically allowed when it is certain that the elevator car is within a given predetermined distance range near the target landing and when the velocity of the elevator car relative to the target landing is below a predetermined limit value. The solution of the invention makes it possible to determine and control the velocity of the elevator cars and therefore their position so that advance opening of the doors can be safely carried out. In practice, to determine the velocity of the elevator cars relative to the target landings, a different calculation has to be performed in at least four different situations, i.e. 1) when the car frame is traveling downwards and the elevator cars are approaching each other within the car frame, 2) when the car frame is traveling downwards and the elevator cars are moving farther away from each other within the car frame, 3) when the car frame is traveling upwards and the elevator cars are approaching each other within the car frame, and 4) when the car frame is traveling upwards and the elevator cars are moving farther away from each other within the car frame. As stated, in each of these aforesaid situations a different calculation with respect to the target landing is needed, and thus it is also necessary to know the directions of motion of the car frame and the elevator cars.

FIG. 3 is diagrammatic representation of a solution according to the invention for implementing the apparatus. A hoisting machine 46 with a traction sheave moves the car frame 2 by means of hoisting ropes 3. Depending on the suspension solution, the arrangement may also comprise a counterweight 47 attached to the hoisting ropes. Fitted to measure and monitor the speed and direction of motion of the car frame 2 is a measuring element 49, which measures the velocity and the direction of motion e.g. from the traction sheave of the hoisting machine 46. Similarly, provided in conjunction with the car frame 2 are measuring means 50 fitted to measure and monitor the velocity and direction of motion of the elevator cars 1*a* and 1*b* in relation to the car frame 2. Each elevator car has separate measuring means 50, which separately measure the velocity of each elevator car relative to the car frame. The velocity measurement action may be carried on all the time while the car frame 2 is moving, but it is carried on at least when the car frame 2 is approaching the target floors 51 and 52.

As velocity is a vectorial quantity, velocity measurement always naturally includes the direction of motion as well. Therefore, hereinafter only velocity measurement is spoken of. The idea of the invention is to measure the velocity of the car frame 2 and the velocity of the elevator cars 1*a* and 1*b* separately and to produce from them the velocity of the cars relative to the target landings 51 and 52. The hoisting machine 46 and the velocity measuring elements 49 and 50 are connected to the elevator control system 48 so that the control system 48 receives the measured velocity data from the measuring elements 49 and measuring means 50. Provided in conjunction with the control system 48 or integrated in the control system are calculating means 53 for processing the measured velocity data. Based on the velocity data calculated by the calculating means 53, the system is adapted to calculate the arrival of the elevator cars 1*a* and 1*b* at the landings 51 and 52 and to determine a point of time at which the doors can be safely opened.

Let us assume that, at an instant of time when the elevator is approaching the target landings 51 and 52, the velocity of the car frame 2 is V and the direction of motion is downwards. Correspondingly, the velocity of the upper elevator car 1*a* relative to the car frame 2 at the same instant of time is $V_a$ and the direction of motion is downwards, and the velocity of the lower elevator car 1*b* relative to the car frame 2 at the same instant of time is $V_b$ and the direction of motion is upwards. Calculated by the calculating means 53, the velocity $V_A$ of the upper elevator car 1*a* relative to the target landing 51 is obtained by subtracting the velocity of the upper elevator car 1*a* relative to the car frame 2 from the velocity of the car frame 2, i.e. as expressed by the equation $V_A=V-V_a$, and similarly the velocity $V_B$ of the lower elevator car 1*b* relative to the target landing 52 is obtained by subtracting the velocity of the lower elevator car 1*b* relative to the car frame 2 from the velocity of the car frame 2, i.e. as expressed by the equation $V_B=V-V_b$.

It is obvious to a person skilled in the art that the invention is not limited to the embodiments described above, in which the invention has been described by way of example, but that many variations and different embodiments of the invention are possible within the scope of the inventive concept defined in the claims presented below. Thus, for example, the aforesaid calculating means may be incorporated in the elevator control system so that they form part of the control system.

It is also obvious to the person skilled in the art that the mechanism used to move the elevator cars in the car frame may be different from that described above. For example, when the mechanical coupling of the elevator cars is such that the elevator cars always move at the same speed but in opposite directions in the car frame, only one velocity measurement is needed. In this case, the velocities $V_a$ and $V_b$ of the elevator cars relative to the car frame are equal. Therefore, the measuring element used to measure the velocity may, for instance, be included in the mechanism moving the elevator cars in the car frame. This provides the advantage of simple velocity measurement and calculation of the velocity of the elevator cars relative to the landings.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A method for controlling advance opening of doors in a double-deck elevator, said method comprising the steps of:

moving a car frame supporting elevator cars by means of a set of hoisting ropes by a hoisting machine provided with a traction sheave; and at least when the elevator is approaching the target floor levels, measuring the velocity of the elevator cars in the car frame in relation to the car frame;

based on the measurement result, calculating the velocity of the elevator cars relative to the floor levels; and passing data calculated in said step of calculating, regarding the velocity of the elevator cars relative to the floor levels to a control system of the elevator for advance opening of the doors.

2. The method according to claim 1, further comprising the steps of:

calculating the velocity of an upper elevator car relative to a higher floor level by subtracting the velocity of the upper elevator car relative to the car frame from the velocity of the car frame; and calculating the velocity of a lower elevator car relative to a lower floor level by subtracting the velocity of the lower elevator car relative to the car frame from the velocity of the car frame.

3. The method according to claim 1, further comprising the steps of:

measuring the velocities of the elevator cars using velocity measuring means provided in conjunction with the car frame; and passing the measurement results to calculating means, said calculating means being used to calculate the velocities of the elevator cars relative to the floor levels.

4. An apparatus for controlling advance opening of doors in a double-deck elevator, said elevator comprising a hoisting machine provided with a traction sheave and which, by means of a set of hoisting ropes, moves a car frame supporting elevator cars, said apparatus comprising:

measuring means for the measurement of velocity of the car frame in relation to the floor levels; and measuring means for measuring the velocities of the elevator cars relative to the car frame;

wherein calculating means are connected to a control system of the elevator to deliver calculated velocity data to the control system, and the control system is adapted to issue a command for advance opening of the doors on the basis of the calculated velocity data.

5. The apparatus according to claim 4, wherein the calculating means are adapted to calculate the velocities of the elevator cars relative to the floor levels on the basis of measured velocity data for the car frame and elevator cars.

6. The method according to claim 2, further comprising the steps of:

measuring the velocities of the elevator cars using velocity measuring means provided in conjunction with the car frame; and passing the measurement results to calculating means, said calculating means being used to calculate the velocities of the elevator cars relative to the floor levels.

* * * * *